US006540225B2

(12) United States Patent
Iwai et al.

(10) Patent No.: US 6,540,225 B2
(45) Date of Patent: Apr. 1, 2003

(54) STORING DEVICE FOR PAPER SHEETS

(75) Inventors: Koji Iwai, Gunma (JP); Atsushi Takayama, Maebashi (JP)

(73) Assignee: Sanden Corporation, Gunma (JP)

( * ) Notice: Subject to any disclaimer, the term of this patent is extended or adjusted under 35 U.S.C. 154(b) by 8 days.

(21) Appl. No.: 09/949,790

(22) Filed: Sep. 12, 2001

(65) Prior Publication Data

US 2002/0060405 A1 May 23, 2002

(30) Foreign Application Priority Data

Sep. 11, 2000 (JP) ..... 2000-274831

(51) Int. Cl.[7] ..... B65H 31/04; G07G 1/14
(52) U.S. Cl. ..... 271/213; 902/9
(58) Field of Search ..... 271/213, 214, 271/215, 217, 112; 902/9, 10, 12, 13, 14, 15, 16

(56) References Cited

U.S. PATENT DOCUMENTS 5,100,022 A * 3/1992 Fukudome et al. ..... 221/198
5,254,841 A * 10/1993 Watabe et al. ..... 235/379
6,352,175 B2 * 3/2002 Izawa et al. ..... 221/197

FOREIGN PATENT DOCUMENTS

| | | | | |
|---|---|---|---|---|
| JP | 3-11490 | * | 1/1991 | ..... G07D/9/00 |
| JP | 05-108925 | | 4/1993 | |
| JP | 8-279065 | | 10/1996 | |
| JP | 2000-113279 | | 4/2000 | |

* cited by examiner

*Primary Examiner*—Donald P. Walsh
*Assistant Examiner*—Kenneth W Bower
(74) *Attorney, Agent, or Firm*—Banner & Witcoff, Ltd.

(57) ABSTRACT

To provide a storing device for paper sheets capable of increasing the number of banknotes that can be stored without increasing the dimension in a back and forth direction of a device main body.

A second plate is moved in a direction substantially perpendicular to a face of a paper sheet by moving other ends of arms substantially parallel to the second plate, and thus drive force of a drive means is applied to the other ends of the arms, thereby moving the other ends of the arms substantially parallel to the second plate. Consequently, a space in the direction substantially perpendicular to the face, which is required for the arm movement, can be reduced as compared with the case in which the center part of the arm is driven.

6 Claims, 13 Drawing Sheets

STORING DEVICE FOR PAPER SHEETS

This application is based upon and claims the benefit of priority from Japanese Patent Application No. 2000-274831, filed Sep. 11, 2000, the entire contents of this application is incorporated herein by reference.

BACKGROUND OF THE INVENTION

1. Field of the Invention

The present invention relates to a storing device for paper sheets for storing paper sheets such as banknotes, gift certificates, and postcards.

2. Description of the Related Art

In the past, a storing device for paper sheets of this kind is generally known including a device main body formed in a box shape, an insertion port for a banknote provided at a front face of the device main body, a conveyor mechanism for conveying an inserted banknote through a conveying passage, a banknote detector for detecting a banknote in the conveying passage, and a banknote storing section for storing banknotes conveyed by the aforementioned conveyor mechanism in a stack. Banknotes are stored in this banknote storing section.

The aforementioned banknote storing section is constituted by a pair of rails placed at both left and right sides of a conveyed banknote, for allowing the banknote to be inserted between them, a first plate placed at the back side of the banknote and forward pressed, a second plate placed at the front side of the banknote and movable in a back and forth direction of the banknote, and a moving mechanism for moving the second plate, the second plate being moved toward the first plate by the moving mechanism.

The aforementioned moving mechanism is constituted by pantograph arms connected to the second plate, intersecting each other in an X form, and extensible and contractible in the back and forth direction, a drive shaft provided at the intersection of the pantograph arms, a cam abutting this drive shaft for moving the drive shaft in the back and forth direction, and a drive motor for driving the cam. Thus, the pantograph arms are extended and contracted back and forth by the drive motor, whereby a banknote is stored in such a manner that it is inserted between the first plate and the rails (for example, Japanese Patent Laid-Open No. 5-108925).

In this storing device for banknotes, when a banknote is conveyed to a space between the rails of the banknote storing section, the moving mechanism moves the second plate backward, so that the second plate moves the banknote to behind the rails. After the banknote moves to behind the rails, the second plate is moved forward to return to the original position, and the banknote is pressed by the front face of the first plate and the rear face of each rail to be stored. Specifically, by repeating the aforementioned operation of moving the drive shaft in the back and forth direction via the cam to reciprocate the second plate, banknotes are stored in a stack in the back and forth direction inside the banknote storing section.

However, when the second plate is reciprocated in the aforementioned banknote storing device, the drive shaft is moved in the back and forth direction (a direction substantially perpendicular to the face of the second plate) via the cam, and thus the dimension in the back and forth direction of the cam, which takes a moving stroke of the drive shaft, becomes large. Accordingly, there arises a disadvantage that the dimension in the back and forth direction of the section for storing banknotes are reduced by the dimension in the back and forth direction of the cam body and thereby the number of banknotes that can be stored decreases. As a result, in the automatic vending machines including the above kind of devices, the stored banknotes have to be frequently collected, which imposes a heavy burden on the banknotes collecting workers.

It can be envisioned to increase the dimension in the back and forth direction of the device in order to increase the number of banknotes that can be stored, but in this case, there arises a disadvantage that the dimensions in the back and forth direction of the other devices should be reduced.

SUMMARY OF THE INVENTION

The present invention is made in view of the aforementioned disadvantages, and its object is to provide a storing device for paper sheets capable of increasing the number of banknotes that can be stored without increasing the dimension in a back and forth direction of a device main body.

In order to attain the aforementioned object, the present invention provides a storing device for paper sheets comprising conveyor means for conveying an inserted paper sheet through a conveying passage, a paper sheet storing section for storing the paper sheets conveyed by the conveyor means in a stack, a first plate placed at one face of the paper sheet inside the paper sheet storing section, a second plate placed at the other face of the paper sheet, and moving means for moving the second plate in a direction substantially perpendicular to the face of the paper sheets, wherein the aforementioned moving means is constituted by arms each connected to the second plate at one end thereof, and drive means for moving the second plate in the direction substantially perpendicular to the face of the paper sheets by moving the other end of the arms substantially parallel to the second plate.

According to the present invention, the drive force of the drive means is applied to the other end of the arms, and the other end of the arms are moved substantially parallel to the second plate, and thus a space in the direction substantially perpendicular to the face, which is required for the arm movement, can be reduced as compared with the case in which the central part of the arm is driven. Consequently, the dimension in the direction substantially perpendicular to the face of the section for storing the paper sheets can be sufficiently secured, thus making it possible to increase the number of paper sheets that can be stored without increasing the dimension in the direction substantially perpendicular to the face of the device main body.

DESCRIPTION OF THE PREFERRED EMBODIMENTS

FIGS. 1 to 7 show a first embodiment of the present invention.

Figure 1:
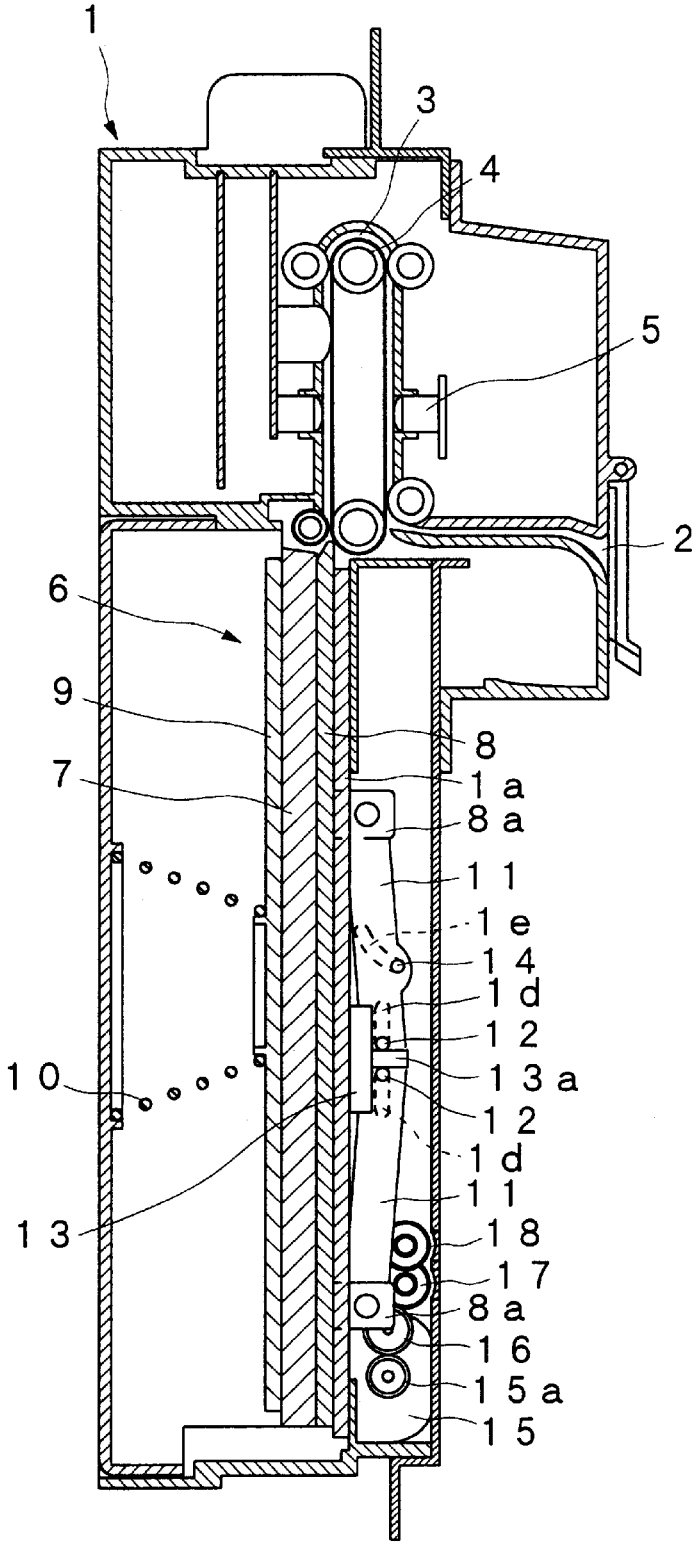
FIG. 1 is a schematic sectional side view of a storing device for paper sheets showing a first embodiment of the present invention.
Figure 3:
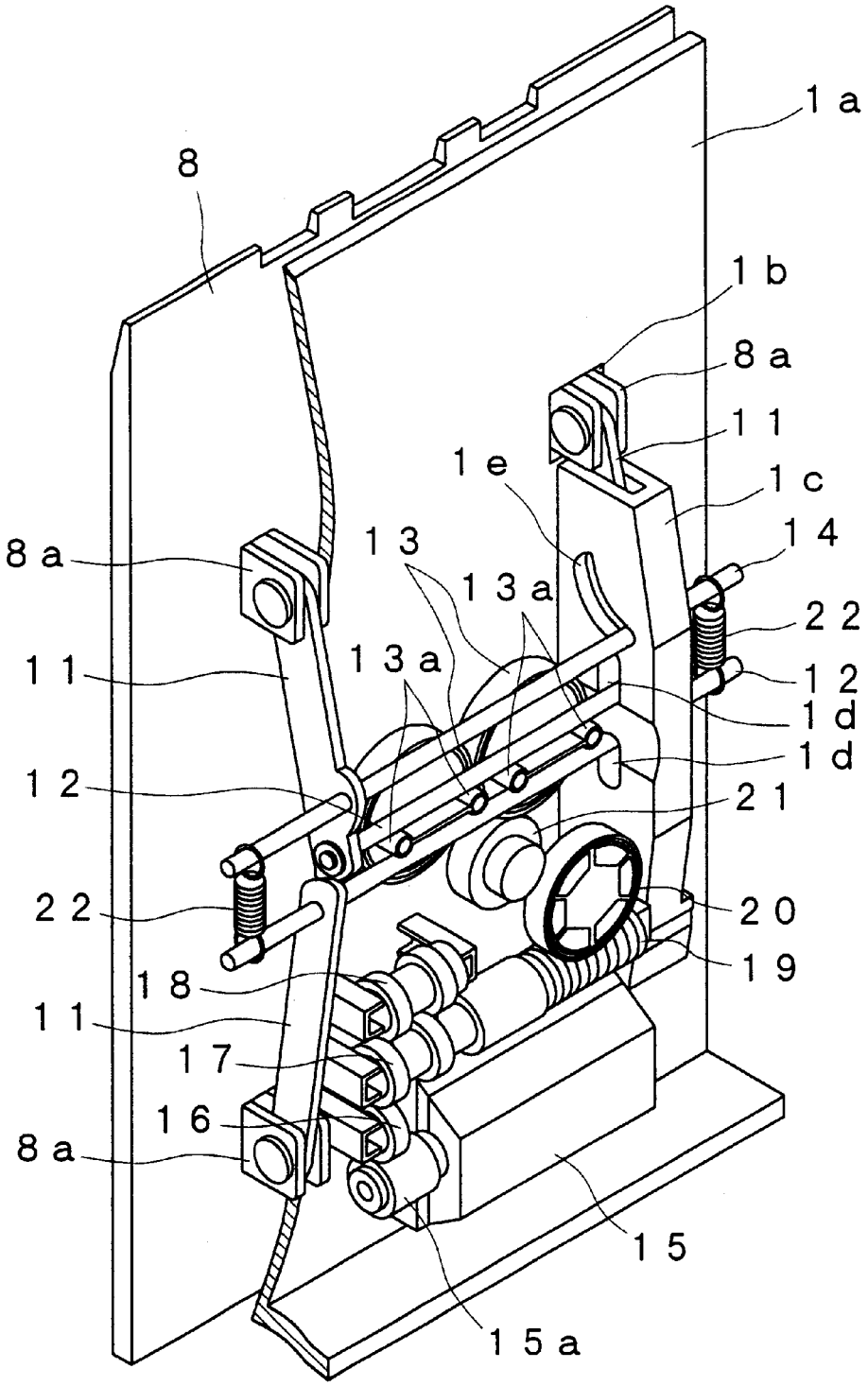
FIG. 3 is a perspective view illustrating essential portions of the storing device for paper sheets.

As shown in FIGS. 1 and 3, this storing device for paper sheets has a banknote storing device main body 1 formed in a box shape, an insertion port 2, which is provided at a front face of the banknote storing device main body 1 and through which a banknote B is inserted substantially horizontally from a longitudinal end portion thereof, a conveying passage 3 formed substantially in a U-shape at an upper portion inside the device main body 1 for guiding the inserted banknote B, a conveyor 4 having a conveyor belt provided along the conveying passage 3 and conveying the banknote B in the conveying passage 3 to an item storing section that will be described hereinafter, a detector for detecting the banknote B inside the conveying passage 3 with an optical sensor or the like, and a banknote storing section 6 provided at a lower portion inside the device main body 1, for storing the banknotes B conveyed by the conveyor 4 in a stack. Further, the banknote storing device main body 1 has a partition plate 1*a* for dividing an inside thereof into a front and rear, which is provided at a front face of a second plate described hereinafter.

The banknote storing section 6 is constituted by a pair of rails 7 each provided at left and right sides of the conveyed banknote B, a second plate 8 placed at a front side of the banknote B, and a first plate 9 placed at a back side of the banknote B. Each of the rails 7 is formed to extend in a vertical direction, and has a concave portion 7*a* extending vertically on an inner side thereof. A distance between the concave portions 7*a* almost corresponds to a lateral length of the banknote B, and the banknote B conveyed in the conveying passage 3 is guided into the banknote storing section 6 by the concave portions 7*a* substantially in a vertical position with its longitudinal direction coinciding with the vertical direction. The second plate 8 is placed at a front of the concave portions 7*a* of the rails 7, and is movable in a direction substantially perpendicular to the face of the banknote B. The second plate 8 is formed with a lateral dimension shorter than the distance between the rails 7, and is movable to the back face of each rail 7 through the space between the rails 7. The first plate 9 is forward pressed by a coil spring 10, and abuts against the back side of each rail 7.

A mounting part 8*a* for an arm 11 is provided at the front face of the second plate 8, and the arm 11 is rotatably mounted on the second plate 8 at one end. In this embodiment, four of the arms 11 are included in total and each pair of left and right arms 11 are provided at upper and lower portions of the second plate 8 so that the other end of each of the upper arms 11 faces downward and the other end of each of the lower arms 11 faces upward. The partition plate 1*a* is provided with a through-hole 1*b* formed such that each arm 11 and the mounting part 8*a* are not in contact with the partition plate 1*a* when the second plate 8 moves, and a cover 1*c* for covering each arm 11 is provided to protrude forward. In this embodiment, a pair of left and right covers 1*c* are formed to extend vertically, and each cover 1*c* covers the two arms 11 at the upper and lower portions. The other ends of the arms 11 laterally corresponding to each other are connected by a drive shaft 12 extending in a lateral direction, and in this embodiment, the drive shafts 12 are provided at an upper side and an lower side. Each of the drive shafts 12 is inserted through a pit 1*d* provided in a side face of each cover 1*c* to be movable up and down and rotatable with respect to each arm 11. Specifically, each arm 11 is connected to the second plate 8 at one end and to the drive shaft 12 at the other end. Each drive shaft 12 abuts against a cam 13, and moves up and down in accordance with a rotational angle of the cam 13. In this embodiment, two of the cams 13 are rotatably supported at support shafts provided at the partition plate la substantially perpendicularly thereto.

The cams 13 are provided side by side in the lateral direction with outer periphery surfaces being meshed with each other, and when one of the cams 13 rotates, the other cam 13 also rotates following it. Each of the cams 13 has a pair of abutting parts 13*a* formed to be cylindrical at the front face thereof. The abutting parts 13*a* abutting to each of the drive shafts 12 are provided symmetrically with respect to a center of rotation of the cam 13, and is formed to be integrated with a component for linking each abutting part 13*a*.

Further, each of the upper arms 11 is provided with a guide shaft 14 in parallel with the drive shaft 12. The guide shaft 14 is guided by a slot 1*e* provided to be curved in the side face of each of the covers 1*c* to guide the arm 11 so that the second plate 8 is surely moved almost in parallel when each of the cams 13 rotates. Specifically, the guide shaft 14 and the slot 1*e* constitute a guide mechanism. The aforementioned guide mechanism may be constructed by providing a guide slot in each arm 11 and the guide shaft 14 at each cover 1*c*.

A motor 15 is disposed at a lower portion of the device main body 1 so that a drive shaft 15*a* thereof is in the lateral direction, and a lower portion of a first gear 16 having a rotating shaft in the lateral direction is meshed with an upper portion of the drive shaft 15*a* of the motor 15. A lower portion of a second gear 17 having a rotating shaft in the lateral direction is meshed with an upper portion of the first gear 16, and an auxiliary gear 18 for stabilizing rotation, having a rotating shaft in the lateral direction is meshed with the upper portion of the second gear 17. A cylindrical worm gear 19 is provided at one end of the rotating shaft of the second gear 17, and a worm wheel 20 having a rotating shaft in the back and forth direction is meshed with the cylindrical worm gear 19. A final gear 21 having a rotating shaft in the back and forth direction is meshed with the worm wheel 20, and one of the cams 13 is meshed with the final gear 21. Specifically, the cams 13, the motor 15, the respective gears and the wheels 16 to 21 constitute drive means.

Further, a coil spring 22 with one end being fixed at the guide shaft 14 and the other end being fixed at the drive shaft 12 at the lower side is provided between the guide shaft 14 and the drive shaft 12. In this embodiment, two of the coil springs 22 are provided in total, and each of them is disposed at both end of the shafts 12 and 14 so as to forward presses the second plate 8 via each of the shafts 12 and 14.

Figure 2A:
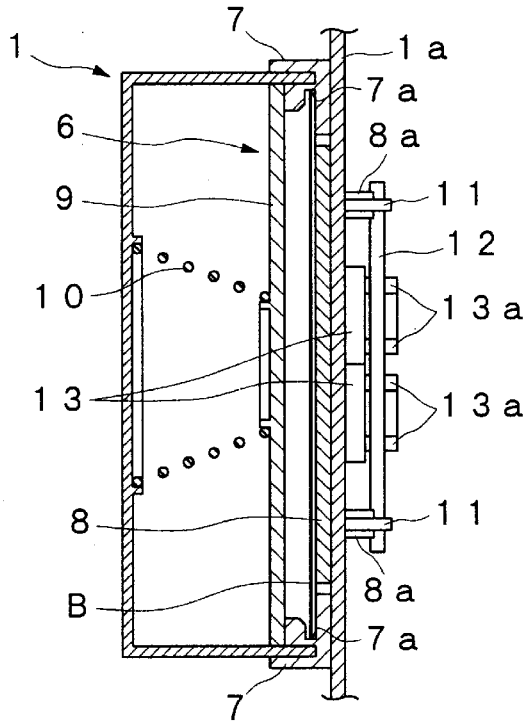
FIGS. 2A and 2B are schematic sectional plan views of the storing device for paper sheets.
Figure 2B:
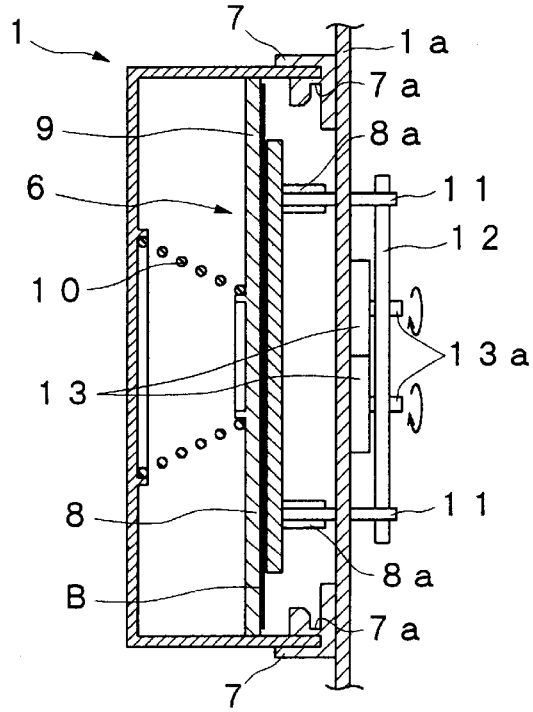
Figure 4:
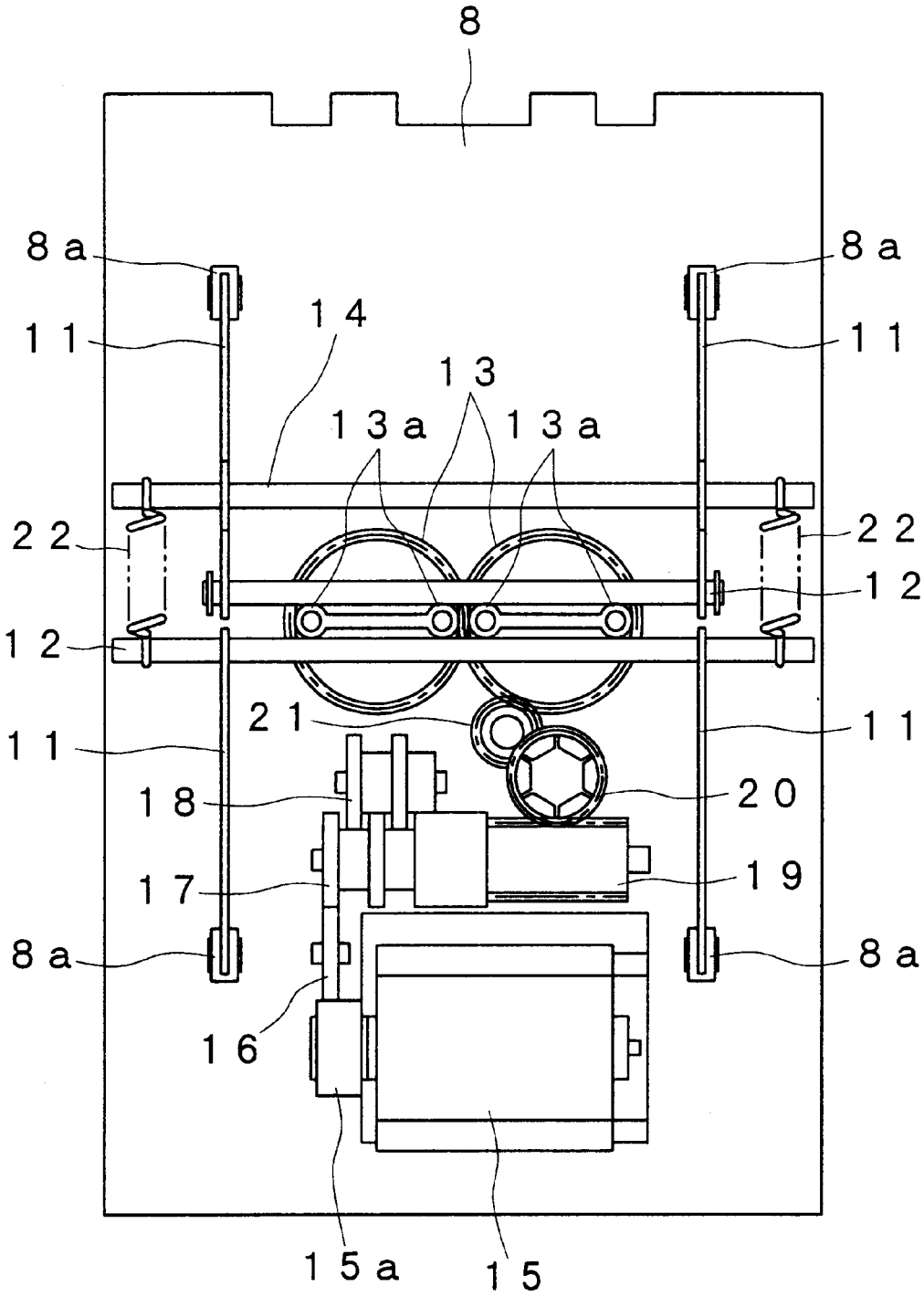
FIG. 4 is a front view illustrating the operation of the storing device for paper sheets.
Figure 5:
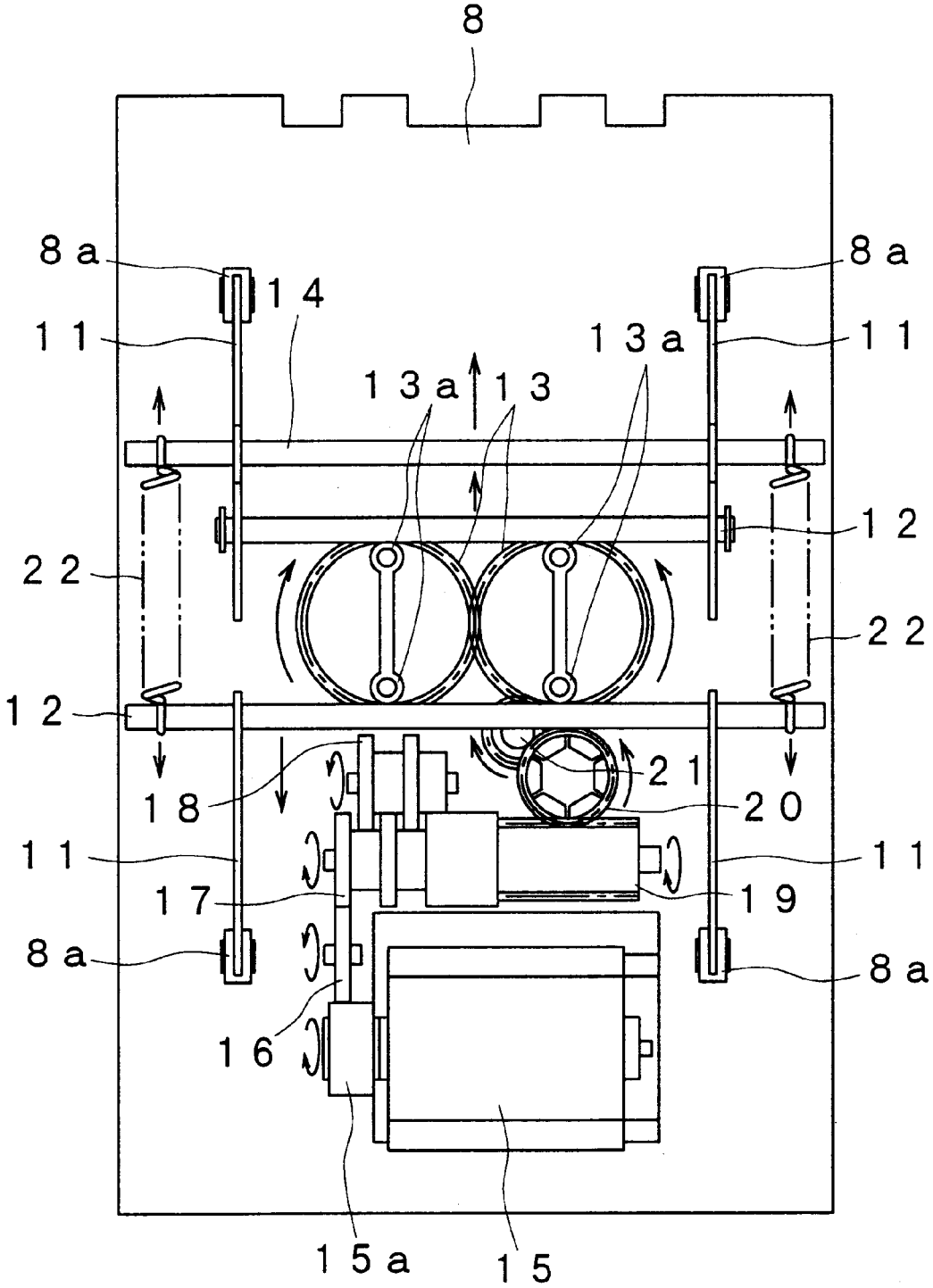
FIG. 5 is a front view illustrating the operation of the storing device for paper sheets.
Figure 6:
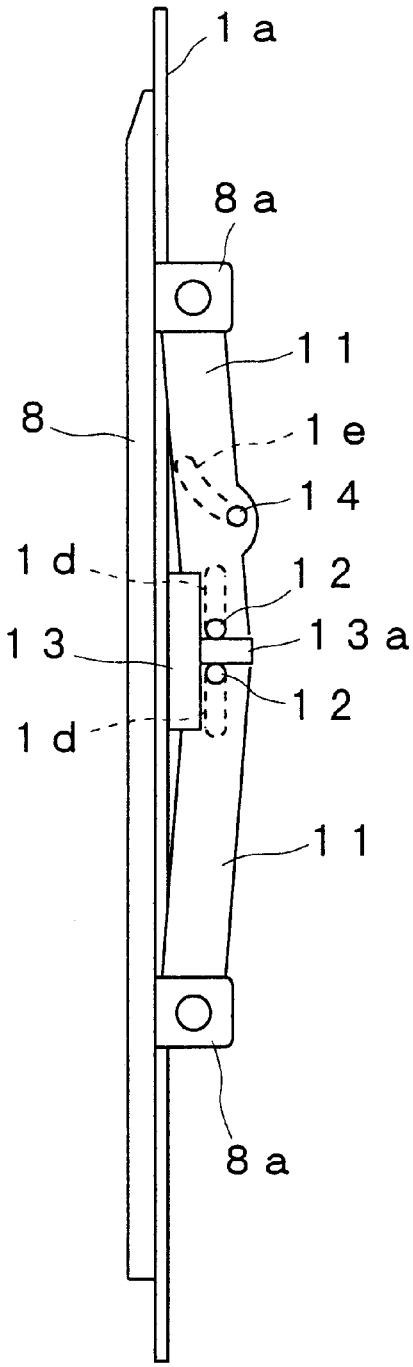
FIG. 6 is a side view illustrating the operation of the storing device for paper sheets.
Figure 7:
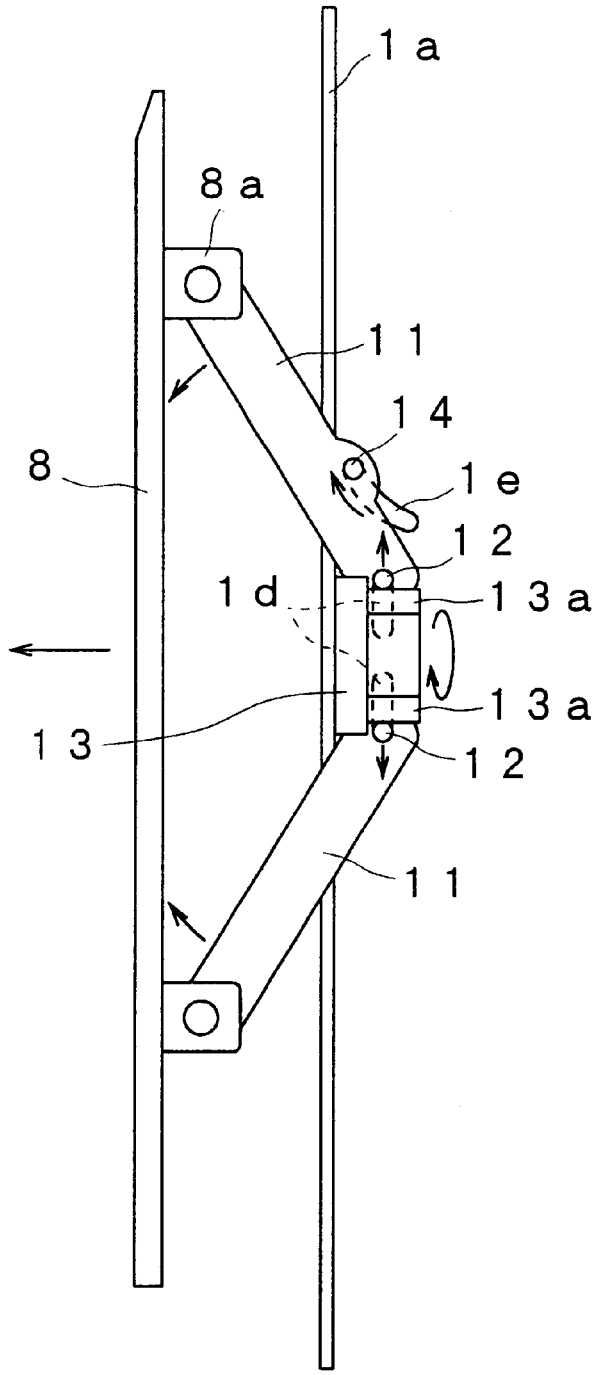
FIG. 7 is a side view illustrating the operation of the storing device for paper sheets.

In the storing device for banknotes configured as described above, the banknote B is conveyed into the space between the rails 7 of the banknote storing section 6, whereby the motor 15 is actuated to rotate each of the cams 13. Here, as an initial state, in each of the cams 13, the abutting parts 13*a* are aligned laterally side by side as shown in FIGS. 4 and 6, and the second plate 8 is placed at the partition plate 1*a* side as shown in FIG. 2A. When each of the cams 13 rotates, as shown in FIGS. 5 and 7, each of the drive shafts 12 abutting thereto moves outside in the vertical direction against the force given by each of the coil springs 22, and with this, the other end of each of the arms 11 moves outside in the vertical direction. Thus, the one end of each arm 11 moves to the back side, thereby moving the second plate 8 to the back side. When the second plate 8 moves to the back side and abuts against the banknote B, the banknote B is pressed out of the rails 7 to the back side and as shown in FIG. 2B, with the left and right end portions of the banknote B coming out of the concave portions 7*a* of the rails 7, it is pressed against the first plate 9. Thereafter, when each of the cams 13 rotates more than 90 degrees from the initial state, the second plate 8 moves forward, and the banknote B is pressed between the second plate 8 and the back side of each of the rails 7 to be stored. When each of the cams 13 rotates 180 degrees, it is returned to the state in which the abutting parts 13*a* are aligned side by side in the lateral direction, specifically, the initial state. By repeating a series of the operations, the banknotes B are stored at the back side of each of the rails 7 in a stack.

As described above, according to the storing device for paper sheets of this embodiment, as the result that each of the drive shafts 12 is driven up and down, the space in the back and forth direction required for each drive shaft 12 to move is made smaller as compared with the conventional storing device for banknotes provided with a shaft moving in the longitudinal direction near the center of an arm, thus making it possible to secure sufficient dimension in the longitudinal direction of the section for storing banknotes. Accordingly, it becomes possible to increase the number of banknotes that can be stored without increasing the dimension in the longitudinal direction of the device.

Further, according to the storing device for paper sheets of this embodiment, one end of each arm 11 is mounted at the second plate 8, while the other end is connected to the drive shaft 12, whereby the force from the drive shaft 12 is exerted on the other end of each arm 11, thus making it possible to reduce the length in a longitudinal direction of each arm 11. Accordingly, it never happens that the arm is bent and thereby the second plate cannot be moved normally as, for example, in the prior art using a pantograph arm. Further, the force from the drive shaft 12 exerts substantially in an axial direction of each arm 11 to make it possible to reduce the stress occurring to each arm 11, thus eliminating the fear of each arm 11 being deformed, and also eliminating the fear of each arm 11 being broken by repeated stress when the device is used for a long time.

Further, according to the storing device for paper sheets of this embodiment, the guide shaft 14 and the slots le are provided, thus making it possible to surely move the second plate 8 in the direction substantially perpendicular to its face with simple constitution.

Furthermore, according to the storing device for paper sheets of this embodiment, each drive shaft 12 is driven by each cam 13, which makes it possible to smoothly move each arm 11 and the second plate 8, and thus excessive load is not added to each portion of the device. When one of the drive shafts 12 moves, a pair of the arms 11 moves the same distance at the same time, and as a result, the second plate 8 can be also moved smoothly.

Figure 8:
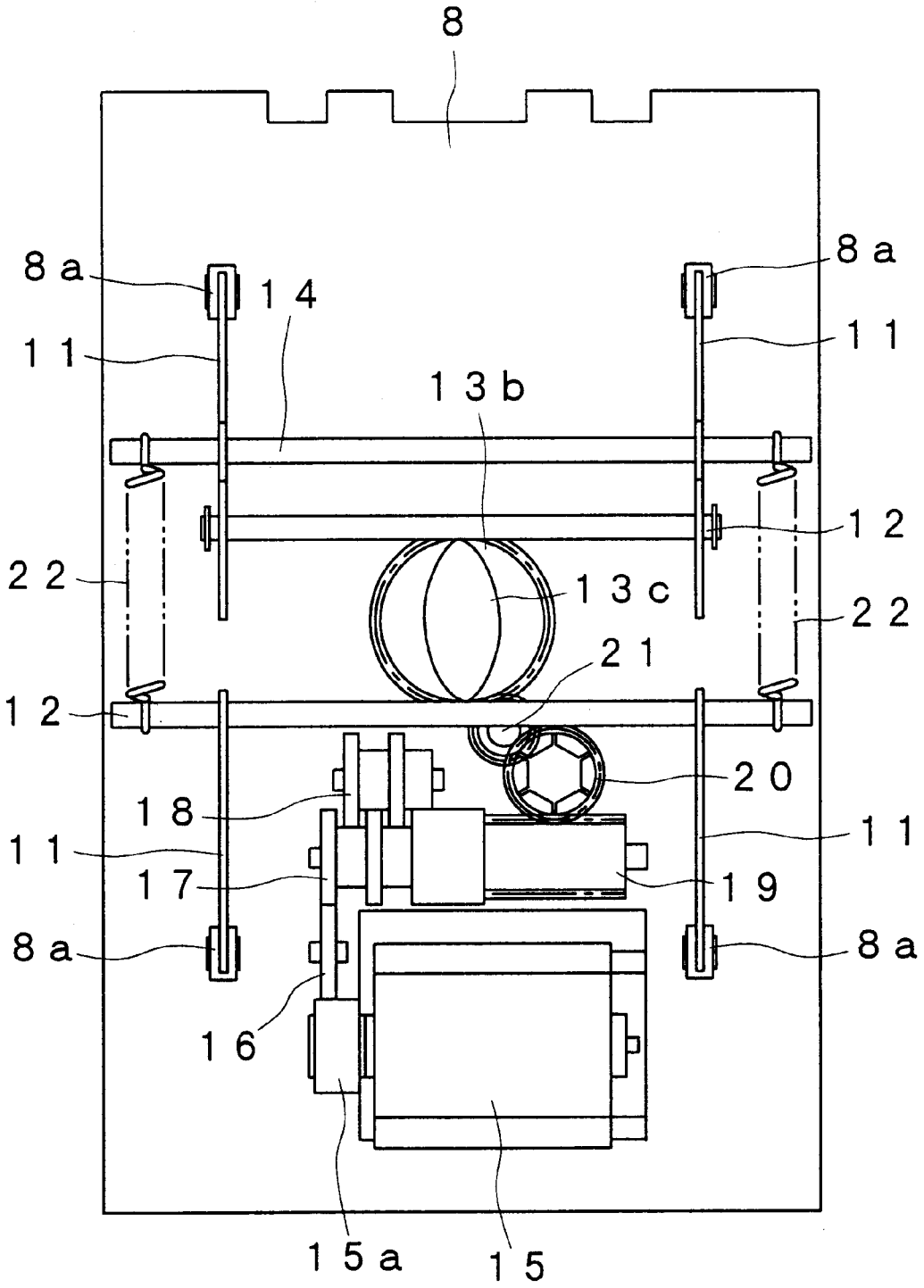
FIG. 8 is a front view illustrating essential portions of the storing device for paper sheets.

In the aforementioned embodiment, it is shown that two of the cams 13 are provided, but as shown in FIG. 8, it may be suitable to drive each of the drive shafts 12 by one cam 13*b*.

Further, in the aforementioned embodiment, it is shown that the cams 13 having the abutting parts 13*a* are provided, but as shown in FIG. 8, it may be suitable to provide the cam 13*b* having on its front face an abutting part 13*c* formed to be curved along its outer periphery. In this case, each drive shaft 12 operates according to the distance between the outer periphery surface and the center of rotation of the cam 13*b*.

Figure 9:
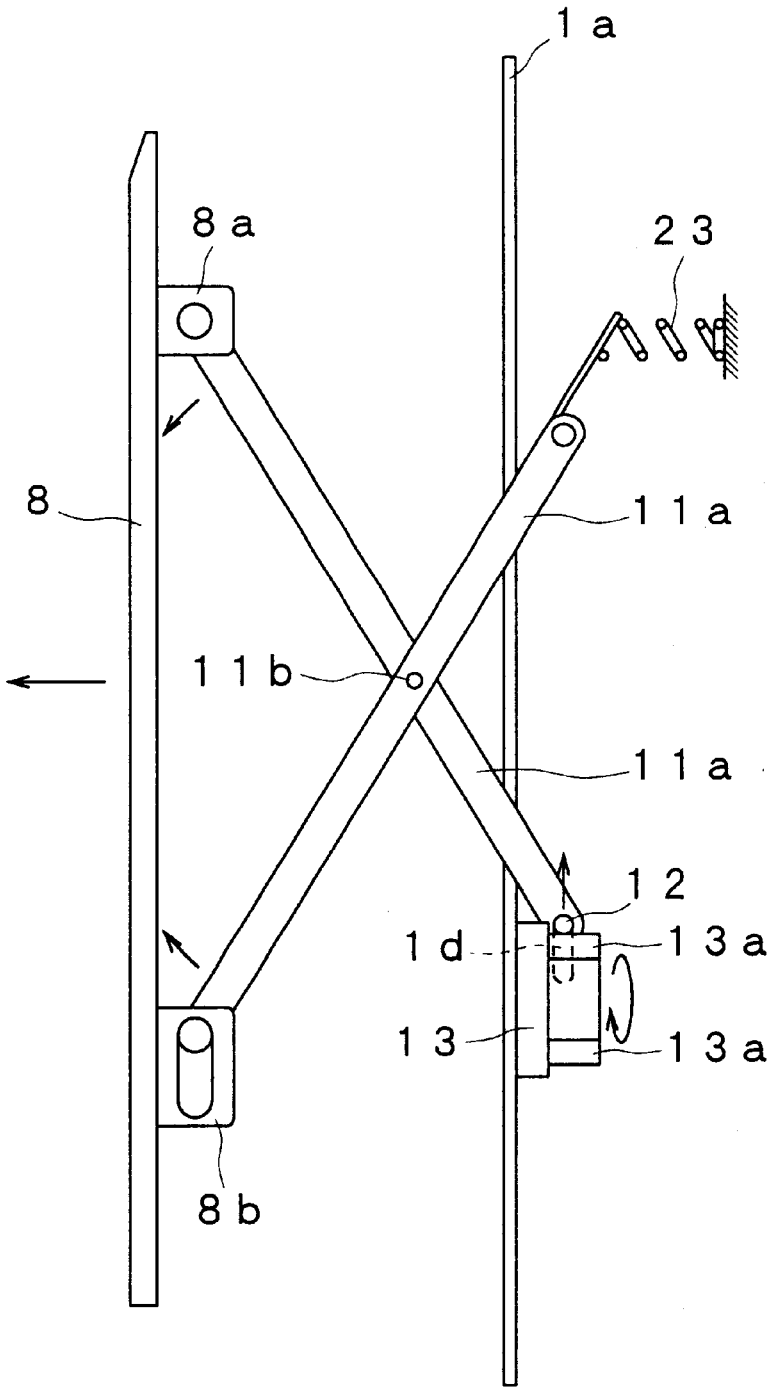
FIG. 9 is a side view illustrating essential portions of the storing device for paper sheets.

Furthermore, in the aforementioned embodiment, it is shown that each arm 11 is independently provided, but as shown in FIG. 9, it may be suitable to provide a pantograph type of arms 11*a* each intersecting in an X form, having an connecting pin 11*b* for the arms at this intersection part, and rotating with the intersection part as a supporting point. In this case, one of the arms 11*a* is driven by the cam 13 at the other end, and the other end of the other arm 11*a* is forward pressed by a coil spring 23. In addition, the other end of the one of the arms 11*a* is rotatably mounted at the mounting part 8*a* of the second plate 8, and the one end of the other arm 11*a* is mounted at a mounting part 8*b* of the second plate 8 so as to be rotatable and movable up and down. In this case, the force of the drive shaft 12 is also exerted in the almost axial direction of the arm 11*a* from the other end of the arm 11*a,* thus making it possible to reduce shearing stress occurring to each arm 11*a* as compared with the prior art in which the force in the almost shearing direction is exerted on the intersection part of each arm.

Further, in the aforementioned embodiment, it is shown that each drive shaft 12 is driven up and down, but it may be suitable that each drive shaft 12 is driven in the lateral direction.

Still further, in the aforementioned embodiment, it is shown that the guide shaft 14 and the slots 1*e* are provided, but it may be suitable that they are not provided.

Further, in the aforementioned embodiment, it is shown that banknotes are stored, but it may be suitable that gift certificates, postcards and the like are stored.

Figure 10:
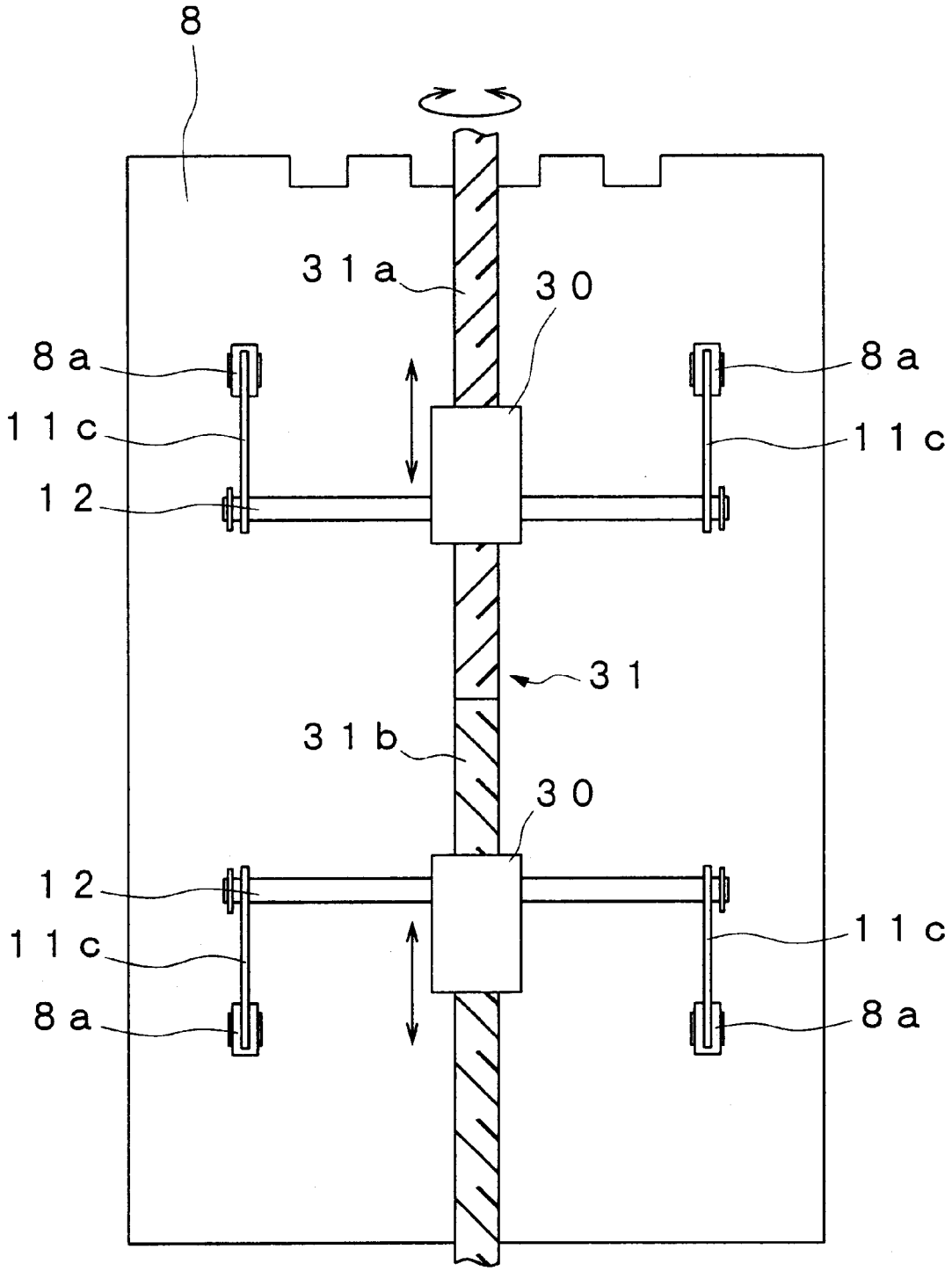
FIG. 10 is a front view illustrating essential portions of a storing device for paper sheets showing a second embodiment of the present invention.
Figure 11:
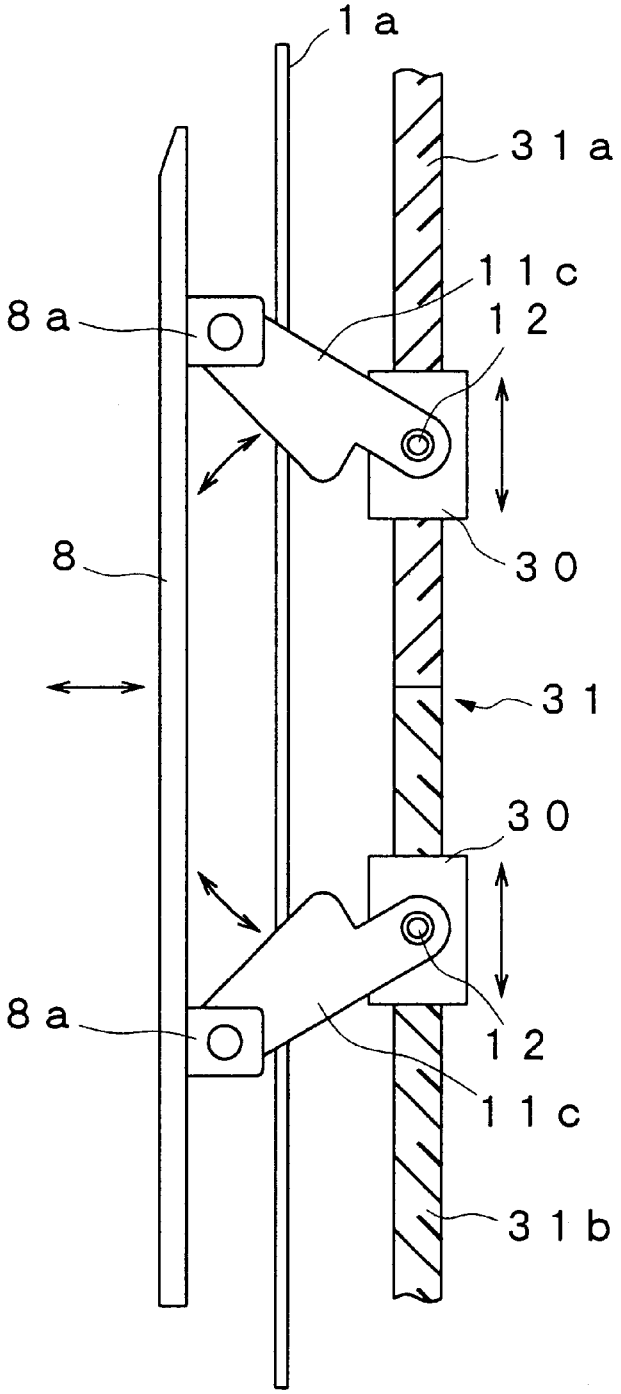
FIG. 11 is a side view illustrating essential portions of the storing device for paper sheets.

FIGS. 10 and 11 show a second embodiment of the present invention. In the second embodiment, the part for driving a drive shaft differs from that in the first embodiment. The other parts that are the same as in the first embodiment will be explained with use of the same numerals and symbols used in the explanation of the first embodiment.

As shown in FIGS. 10 and 11, the storing device for paper sheets has movable parts 30 each connected to each shaft 12 connecting to an arm 11*c* in almost a center of the shaft 12 toward the upper side and lower side, a screw shaft 31 extending in an up and down direction for engaging with each of the movable parts 30, and a motor not shown for driving the screw shaft 31.

Each movable part 30 is formed in a box shape and has a female screw portion extending in the up and down direction therein. Male screw portions 31*a* and 31*b* for being engaged with the aforementioned female screw portions are formed on a periphery surface of the screw shaft 31, screw threads of the upper male screw portion 31*a* and the lower male screw portion 31*b* are cut in the opposite direction to each other. Specifically, when the screw shaft 31 rotates in one direction, the upper movable part 30 moves upward and the lower movable part 30 moves downward, and when the screw shaft 31 rotates in the other direction, the upper movable part 30 moves downward and the lower movable part 30 moves upward. The screw shaft 31 is meshed with a drive section of a motor not shown at the lower portion thereof.

In the storing device for paper sheets configured as described above, when the banknote B is conveyed between the rails 7 of the banknote storing section 6, the motor is actuated to rotate the screw shaft 31. Here, as an initial state, the upper movable part 30 is located at a lower position and the lower movable part 30 is located at an upper position, in other word, the second plate 8 is located at the front side. When the screw shaft 31 rotates in one direction, each movable part 30 moves outside in the up and down direction, and following this, an other end of each arm 11*c* moves outside in the up and down direction. Thus, one end of each arm l1*c* moves to the back side and the second plate 8 moves to the back side. When the second plate 8 moves to the back side and abuts against the banknote B, the banknote B is pressed out of the rails 7 to the back side, and the left and right end portions of the banknote B come out of the concave portion 7*a* of each rail 7 to be pressed against the first plate 9. Thereafter, the screw shaft 31 reverses, then the second plate 8 moves forward, and the banknote B is pressed between the second plate 8 and the back side of each rail 7 to be stored. By repeating a series of the operations, the banknotes B are stored at the back side of each rail 7 in a stack.

As described above, according to the storing device for paper sheets of the second embodiment, each drive shaft 12 is driven in the up and down direction as in the first embodiment, thus making it possible to reduce the space in the back and forth direction required for each drive shaft 12 to move, and reduce the dimension in the back and forth direction of the device. Further, since the one end of each arm 11*c* for moving the second plate 8 is mounted to the second plate 8, and the other end thereof is connected to the drive shaft 12, the force from the drive shaft 12 is exerted on the other end of each arm 11*c* and the longitudinal length of each arm 11*c* can be reduced. Further, the force from the drive shaft 12 is exerted in the axial direction of each arm 11*c* and shearing stress occurring to each arm 11*c* can be reduced, thus eliminating the fear of each arm 11*c* being deformed, and also eliminating the fear of each arm 11*c* being broken by repetitive stress when the device is used for a long time.

Further, according to the storing device for paper sheets in the second embodiment, the screw shaft 31 and each of the movable parts 30 for being engaged therewith are provided so that each movable part 30 moves up and down when the screw shaft 31 rotates, thus making it possible to smoothly move each arm 11*c* and the second plate 8, whereby excessive load is not added to each part of the device.

Figure 12:
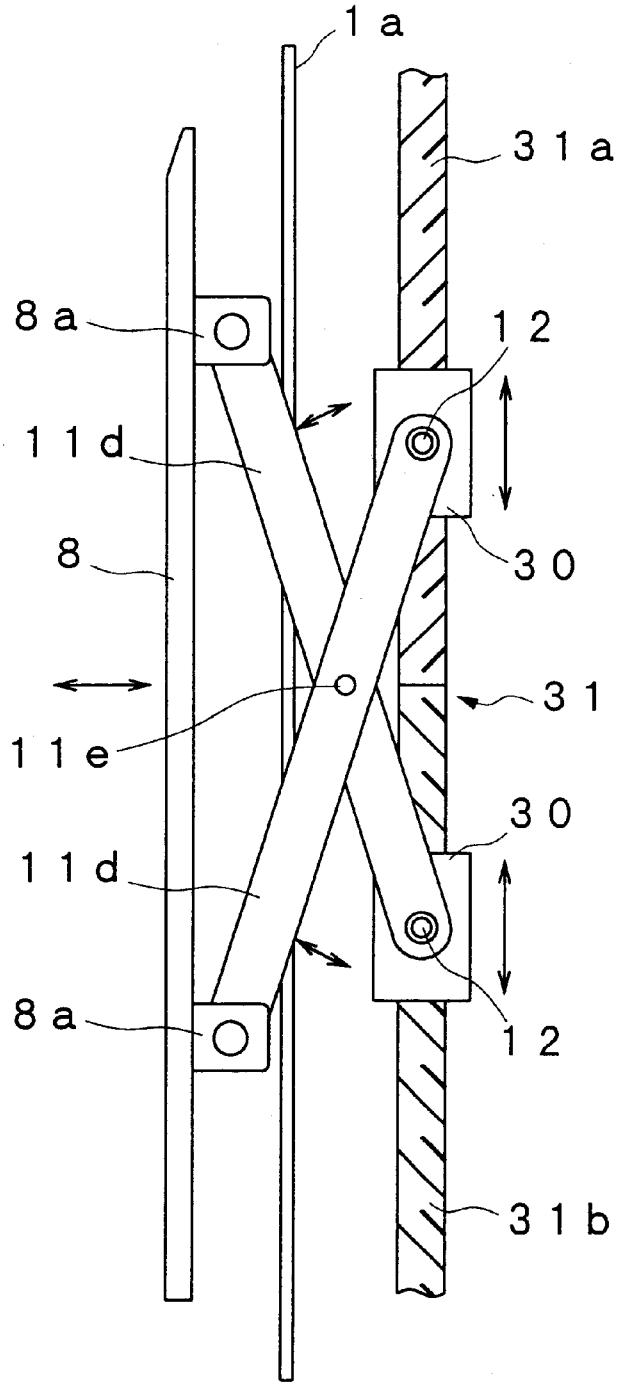
FIG. 12 is a side view illustrating essential portions of the storing device for paper sheets.

In the aforementioned embodiment, it is shown that each arm 11*c* is independently provided, but as shown in FIG. 12, it may be suitable to provide pantograph type of arms lid each intersecting in the X form, having a connecting pin 11*e* for each arm at the intersection part, and rotating with the intersection part as a supporting point. In the case of the device shown in FIG. 12, it has the movable parts 30 at the upper side and the lower side as in the aforementioned second embodiment, and each movable part 30 moves up and down as in the second embodiment to move the second plate 8 in the back and forth direction.

Figure 13:
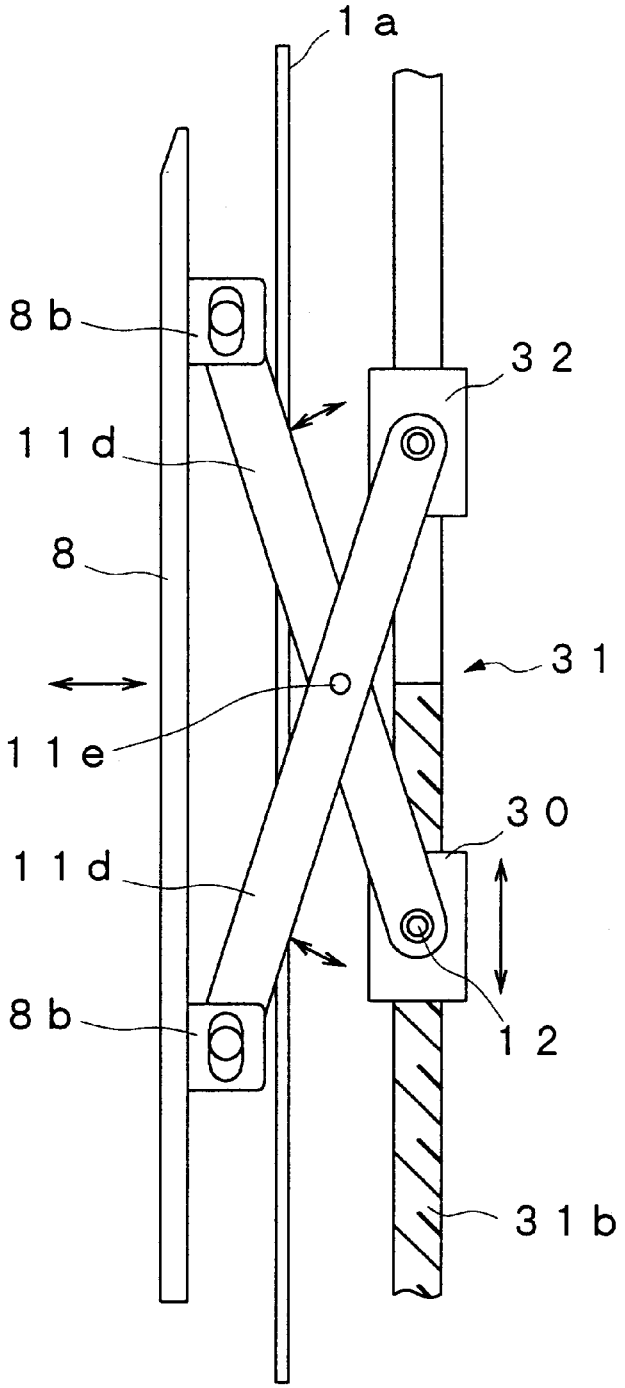
FIG. 13 is a side view illustrating essential portions of the storing device for paper sheets.

Further, as another example provided with pantograph type of arms lid, the example in which one of the movable parts 30 is provided at a lower side and the other end of one of the arms lid is driven by this movable part 30, while the other end of the other arm lid is rotatably supported at a fixed part 32 is cited as shown in FIG. 13. In the case of the example shown in FIG. 13, the screw shaft 31 has the male screw portion 31*b* at only the lower side, and each of the arms 11*d* is mounted at a mounting part 8*b* of the second plate 8 to be rotatable and movable up and down.

In any of the examples shown in FIGS. 12 and 13, the force of the drive shaft 12 is exerted in almost an axial direction of the arm 11*d* from the other end of each arm lid, thus making it possible to decrease stress occurring to each arm 11*d*.

What is claimed is:

1. A storing device for paper sheets, comprising:

conveyor means for conveying an inserted paper sheet through a conveying passage;

a paper sheet storing section for storing paper sheets conveyed by the conveyor means in a stack;

a first plate placed at one face of the paper sheet inside the paper sheet storing section;

a second plate placed at the other face of the paper sheet; and moving means for moving the second plate in a direction substantially perpendicular to the face of the paper sheet, wherein said moving means comprises arms each connected to the second plate at one end thereof, and drive means for moving the second plate in the direction substantially perpendicular to the face of the paper sheet by moving the other ends of the arms substantially parallel to the second plate.

2. The storing device for paper sheets according to claim 1, wherein said drive means has drive shafts connected to the other ends of the arms and moving substantially parallel to the second plate.

3. The storing device for paper sheets according to claim 2, wherein said drive means has cams for abutting to said drive shaft to move the drive shaft.

4. The storing device for paper sheets according to claim 2, wherein said drive means has a screw shaft extending substantially parallel to the second plate, and movable parts for engaging with the screw shaft to move said drive shaft with the aid of rotation of the screw shaft.

5. The storing device for paper sheets according to claim 1, further comprising guide means for guiding said second plate in a direction substantially perpendicular to a face thereof.

6. The storing device for paper sheets according to claim 5, wherein said guide means comprises a guide shaft provided at said arms and slots for guiding the guide shaft.

* * * * *